United States Patent [19]

Italici

[11] Patent Number: 4,592,091

[45] Date of Patent: May 27, 1986

[54] COMPOSITE HANDLE FOR PORTABLE CONTAINERS

[75] Inventor: Rino Italici, San Lazzaro di Savena, Italy

[73] Assignee: Lucas International s.r.l., Emilia, Italy

[21] Appl. No.: 636,762

[22] Filed: Aug. 1, 1984

[30] Foreign Application Priority Data

Aug. 9, 1983 [IT] Italy ..... 15235/83[U]

[51] Int. Cl.[4] ..... A45C 13/26; B65D 33/06

[52] U.S. Cl. ..... 383/15; 383/17; 383/24; 150/107; 190/115; 190/117; 16/110 R; 16/125

[58] Field of Search ..... 383/6, 11, 15, 17, 24; 190/102, 117, 115; 150/107; 229/52 AL; 16/110 R, 125

[56] References Cited

U.S. PATENT DOCUMENTS

| | | | |
|---|---|---|---|
| D. 154,119 | 6/1949 | Gumbrill | 150/107 X |
| 1,359,461 | 11/1920 | Luce | 383/15 |
| 1,400,499 | 12/1921 | Henderson | 383/15 X |
| 2,053,630 | 9/1936 | Plotkin | 190/901 X |
| 2,318,563 | 5/1943 | Smith | 150/107 |
| 3,320,995 | 5/1967 | Reiter | 150/107 X |
| 3,327,365 | 6/1967 | Damast | 150/107 X |
| 3,784,084 | 1/1974 | Pearl | 383/15 |
| 4,210,244 | 7/1980 | Westrick | 383/15 X |
| 4,240,480 | 12/1980 | Strobel | 383/15 |
| 4,424,841 | 1/1984 | Smith | 190/102 X |

FOREIGN PATENT DOCUMENTS

| | | | |
|---|---|---|---|
| 2215675 | 10/1973 | Fed. Rep. of Germany | 383/6 |
| 2834634 | 2/1980 | Fed. Rep. of Germany | 383/15 |
| 842681 | 7/1960 | United Kingdom | 383/17 |

*Primary Examiner*—William Price
*Assistant Examiner*—Sue A. Weaver
*Attorney, Agent, or Firm*—Pollock, Vande Sande & Priddy

[57] ABSTRACT

A composite handle for containers to be hand-carried by a person, comprising a pair of handles each fastened to a side of the container, and each consisting of two straps of flexible strong material, the two straps of each handle being fastened together at an intermediate section which is the section to be gripped by the user. The intermediate section of one handle is removably secured to the corresponding intermediate section of the other handle in superposed relation, so as to obtain, at the mutually engaged intermediate portions of each handle, a single composite gripping section having sufficient thickness and rigidity to allow easy gripping by the user.

4 Claims, 6 Drawing Figures

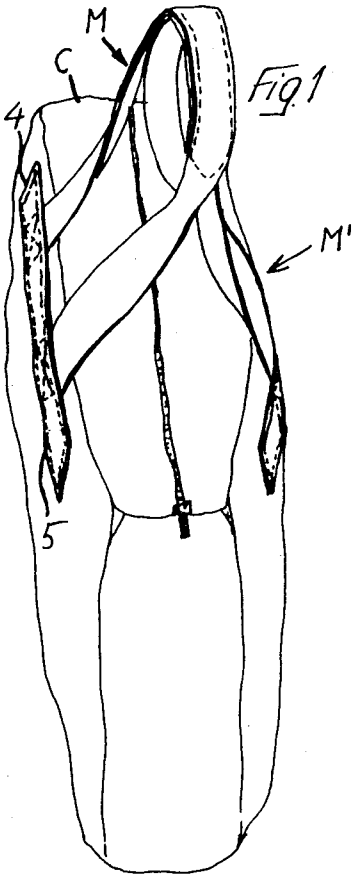
Fig. 1
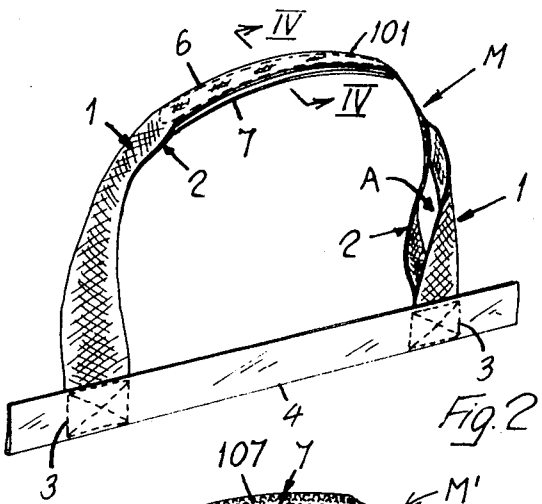
Fig. 2
Fig. 3
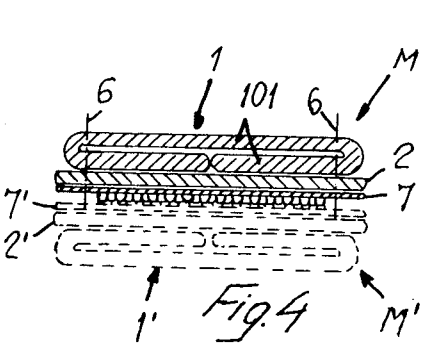
Fig. 4
Fig. 5
Fig. 6

COMPOSITE HANDLE FOR PORTABLE CONTAINERS

SUMMARY OF THE INVENTION

The present invention relates to a composite handle for containers to be hand-carried by a person, such as bags, suitcases or the like, preferably of the soft type.

The composite handle according to the invention comprises a pair of handles each fastened to a side of the container, and each consisting of at least two straps of flexible strong material, the said two straps of each handle being fastened together at an intermediate section which is the section to be gripped by the user. Means are provided for securing by mutual engagement in a removable manner the intermediate section of one handle to the corresponding intermediate section of the other handle in superposed relation, so as to obtain, at the mutually engaged intermediate portions of each handle, a single composite gripping section having sufficient thickness and rigidity to allow an easy gripping by the user.

BRIEF DESCRIPTION OF THE DRAWINGS

The characteristic features of the composite handle according to the invention, and the advantages arising therefrom, will more clearly appear from the following specification, made with reference to the accompanying drawings, in which:

FIG. 1 is a perspective view showing the two handles of a bag made according to the invention, in their mutually joined condition of use;

FIGS. 2 and 3 are perspective views showing respectively the handle on the left-hand side and the handle on the right-hand side of the bag according to FIG. 1;

FIG. 4 is a cross-sectional view taken on line IV—IV of FIG. 2, showing constructional details of the handles;

FIGS. 5 and 6 show, in a view similar to FIG. 4, two modifications in the construction of the handles according to the invention.

DESCRIPTION OF THE PREFERRED EMBODIMENT

Referring first to FIGS. 1, 2, 3 and 4, the handles M, M′ of bag C each consist of two flexible straps 1 and 2 of equal length, of which the strap denoted by numeral 1 has a width substantially twice that of the other strap 2. The straps 1 and 2 may be made, for example, from a suitable fabric. The ends of straps 1 and 2 are set in a mating superposed relation, and by means of sewing or by stitches 3 are fastened to a strip 4 of flexible material, which by means of sewing or by stitches 5 is subsequently fastened to the side of the bag C. It is understood that the straps 1 and 2 may be otherwise fastened to the bag C, even without the use of said strip 4. The ends of strap 2 are arranged in contact with container C, while the ends of strap 1 are arranged in contact with the strip 4, and are placed so as to cover with a symmetrical disposition the said ends of strap 2.

By turning its edges inwardly, the strap 1 is C-folded over a sufficiently long intermediate section 101, and is preferably secured by glueing in such a configuration. The section 101 of strap 1 is thus caused to assume a width dimension substantially equal to that of strap 2, to which it is fastened by lengthwise and endwise sewing or stitches 6. In opposite relation to the thickened reaction 101 of strap 1, a strip 7 is fastened on the strap 2 with its free surface 107 having adhesive properties, e.g., of the type known on the market under the registered trademark "VELCRO". The adhesive strip 7 can be fastened by glueing it on the strap 2 and by sewing or stitches 6, as above described.

The straps 1, 2 and the strip 7 may be of the same or a different color. The thus obtained handles M and M′ are disposed as shown in FIGS. 1, 2, 3, so as to have one of these handles with the adhesive strip 7 turned downward, and the other handle with the matching strip 7′ turned upwards. It is thus possible to place the intermediate sections 101 of the two handles one over the other, so as to cause the reciprocal engagement of said handles thanks to the adhesive strips 7, 7′, as shown also in FIG. 4. In this Figure, the construction of handle M is shown in solid lines, and the construction of the other handle M′ is shown in dash lines. In this way, a single composite handle is obtained, in which the intermediate section which is gripped by the user is formed by the superposed, thickened intermediate sections of the individual handles M, M′, whereby the resulting composite handle has a large cross-sectional area, and is sufficiently rigid, to be handled in a practical and remarkably comfortable manner. Since the resulting composite handle is single, the same can be more easily gripped by the user.

By devaricating the unfastened lengths of straps 1 and 2 constituting each handle, there can be formed a slit aperture A, into which there may be inserted an object such as a newspaper, and umbrella, a raincoat, or the like.

It is understood that the described handle may be modified. For example, the strap 1 may have a width substantially equal to that of strap 2. The ends of straps 1 and 2 may even not be in a superposed relation. The adhesive strip 7 may be fastened in one handle on the strap 2 and in the other handle on the strap 1, or in both handles on the strap 1.

As shown in FIG. 5, inside the inwardly turned section 101 of strap 1 of each handle there may be incorporated a strip 8 of any material suitable for strengthening the intermediate section of the handle itself. According to a different embodiment, as shown in FIG. 6, the intermediate section of strap 2 may be incorporated at the interior of section 101 of strap 1. Instead of the adhesive strips 7 of the kind above specified, other means may be used for securing in a removable manner the two handle portions 101.

I claim:

1. A composite handle for a portable container, comprising (a) a pair of handles (M, M′) each fastened to a side of said container (C), and each handle consisting of at least two straps (1, 2) of flexible strong material, said two straps of each handle being fastened together at an intermediate section (101) to be gripped by a user; and (b) adhesive strip means (7) for removably securing by mutual engagement an intermediate section (101) of one handle (M) to a corresponding intermediate section (101) of the other handle (M′), in superposed relation, so as to obtain, at said mutually engaged intermediate portions (101) of each handle (M, M′), a single composite gripping section having sufficient thickness and rigidity to allow easy gripping by said user;

(c) one of said two straps composing each handle having a width which is approximately twice the width of the other of said straps, said double-width strap being folded over its longitudinal edges at said intermediate section so as to reduce its width, at said intermediate section, substantially to the width of said other strap.

2. A composite handle according to claim 1, wherein said adhesive strips means consist of strips of VELCRO (registered trademark).

3. A composite handle according to claim 1, wherein the said strap having a smaller width is incorporated, at said intermediate section, inside said strap having a double width, by folding the edges of the latter strap over said smaller width strap.

4. A composite handle according to claim 1, wherein a stiffening and strengthening strip (8) having substantially the same length and width as said intermediate section is incorporated at the latter section, inside said strap having a double width, by folding the edges of said double-width strap over said stiffening and strengthening strip (8).

* * * * *